US011064303B2

(12) United States Patent
Cho et al.

(10) Patent No.: US 11,064,303 B2
(45) Date of Patent: Jul. 13, 2021

(54) BELLOWS VIBRATION BODY AND HEARING AID COMPRISING SAME

(71) Applicant: KYUNGPOOK NATIONAL UNIVERSITY INDUSTRY-ACADEMIC COOPERATION FOUNDATION, Daegu (KR)

(72) Inventors: Jin-ho Cho, Daegu (KR); Hyung Gyu Lim, Daegu (KR); Dong Ho Shin, Busan (KR); Ki Woong Seong, Daegu (KR)

(73) Assignee: KYUNGPOOK NATIONAL UNIVERSITY INDUSTRY-ACADEMIC COOPERATION FOUNDATION, Daegu (KR)

( * ) Notice: Subject to any disclaimer, the term of this patent is extended or adjusted under 35 U.S.C. 154(b) by 181 days.

(21) Appl. No.: 16/334,849

(22) PCT Filed: Sep. 13, 2017

(86) PCT No.: PCT/KR2017/010048
§ 371 (c)(1),
(2) Date: Mar. 20, 2019

(87) PCT Pub. No.: WO2018/056631
PCT Pub. Date: Mar. 29, 2018

(65) Prior Publication Data

US 2020/0021926 A1 Jan. 16, 2020

(30) Foreign Application Priority Data

Sep. 20, 2016 (KR) ..... 10-2016-0119869

(51) Int. Cl.
*H04R 25/00* (2006.01)

(52) U.S. Cl.
CPC ..... *H04R 25/606* (2013.01); *H04R 2225/023* (2013.01)

(58) Field of Classification Search
CPC .. H04R 25/606; H04R 2225/67; H04R 25/02; H04R 25/652; H04R 2225/023
See application file for complete search history.

(56) References Cited

U.S. PATENT DOCUMENTS 5,282,858 A 2/1994 Bisch
8,216,123 B2 7/2012 Cho
(Continued)

FOREIGN PATENT DOCUMENTS

KR 100856484 9/2008
KR 100859979 9/2008
(Continued)

OTHER PUBLICATIONS

International Search Report dated Jan. 8, 2018 for corresponding PCT/KR2017/010048, with English translation, 4 pages.
(Continued)

*Primary Examiner* — Amir H Etesam
(74) *Attorney, Agent, or Firm* — Ohlandt, Greeley, Ruggiero & Perle, L.L.P.

(57) ABSTRACT

A hearing aid having a bellows vibration body is disclosed. The hearing aid comprises: an external unit having a microphone for converting an external voice into an electrical signal; an internal unit which can be implanted under the skin and is for communicating with the external unit; a bellows vibration body which can be connected to the auditory ossicles and comprises a non-magnetic body; and an audio transmission tube for transmitting an acoustic signal, which is output from the internal unit, to the bellows vibration body, wherein the bellows vibration body vibrates in accordance with the acoustic signal transmitted by means
(Continued)

of the audio transmission tube and thus transmits the vibration to the auditory ossicles.

10 Claims, 8 Drawing Sheets

(56) References Cited

U.S. PATENT DOCUMENTS

| | | | | |
|---|---|---|---|---|
| 10,057,696 | B2 | 8/2018 | Cho | |
| 2007/0083078 | A1* | 4/2007 | Easter | H04R 25/606 600/25 |
| 2013/0225912 | A1* | 8/2013 | Leigh | H04R 25/606 600/25 |
| 2014/0128661 | A1 | 5/2014 | Ball | |
| 2015/0051667 | A1 | 2/2015 | Van Der Borght | |

FOREIGN PATENT DOCUMENTS

| | | |
|---|---|---|
| KR | 200449881 | 8/2010 |
| KR | 101548344 | 9/2015 |
| WO | 2007044460 | 4/2007 |

OTHER PUBLICATIONS

Written Opinion of the International Searching Authority dated Jan. 8, 2018 for corresponding PCT/KR2017/010048, with English translation, 11 pages.

Korean Office Action dated May 25, 2017 for corresponding Korean Patent Application No. 10-2016-0119869 with English translation, 7 pages.

Decision to Grant a Patent (issuance date: Nov. 23, 2017) issued by the Korean Patent Office for Korean Patent Application No. 10-2016-0119869 which was filed on Sep. 20, 2016, with English translation, 6 pages.

* cited by examiner

BELLOWS VIBRATION BODY AND HEARING AID COMPRISING SAME

TECHNICAL FIELD

The present disclosure relates to a vibration body and a hearing aid that include a bellows structure.

BACKGROUND ART

The types of hearing loss may be generally classified into a mild hearing loss group which may solve the hearing loss with the aid of an existing hearing aid, middle and high hearing loss groups that can not easily solve the hearing loss with the aid of the existing hearing aid, and high hearing loss and congenital hearing impairment groups that may solve the hearing loss with aid of cochlear implants only. Here, a hearing loss solving method targeted to the middle and high hearing loss groups is relatively poor, and many people who have hearing loss are thus experiencing discomfort.

Therefore, various implantable hearing aid models are studied worldwide for the middle and high hearing loss groups. A successful model in a hearing aid market uses an electromagnetic floating mass transducer (TMT) installed in the auditory ossicles as a transducer. In addition to this, there is a method of using a piezoelectric vibration body.

DISCLOSURE

Technical Problem

An object of the present disclosure is to provide a bellows vibration body that minimizes an influence of a magnetic field and improve vibration characteristics, and a hearing aid including the same.

Technical Solution

Unlike an existing method that operates in the auditory ossicles, according to the present disclosure, a bellows member that vibrates with acoustic signal and a mass member interact and operate in a floating mass form, and frequency characteristics of a vibration output are adjusted by adjusting a weight of the mass member and a corrugate form of the bellows. An object of the present disclosure is to provide a bellows vibration body and a hearing aid that assure an excellent vibration displacement without being influenced by an external magnetic field such as an MRI imaging, and that are easy to perform a transplant operation by not using an electric wire as a connection between the vibration body and an implantable hearing aid.

According to an aspect of the present disclosure, a bellows vibration body includes a bellows member connected to an audio transmission tube that transmits an acoustic signal and vibrating according to the acoustic signal; an auditory ossicle coupling member connected to one end of the bellows member and formed to be coupled to auditory ossicles to transmit vibration of the bellows member to the auditory ossicles; and a mass member formed on the other end of the bellows member so that the vibration of the bellows member is transmitted to the auditory ossicle coupling member.

The mass member and the bellows member may be disposed on the same central axis, and the audio transmission tube may be connected to the bellows member to penetrate through the mass member along the central axis of the mass member.

The bellows vibration body may further include a cylinder formed on one end of the bellows member, wherein the cylinder may be connected to the audio transmission tube in a hollow state, and the auditory ossicle coupling member may be coupled to the cylinder.

The auditory ossicle coupling member may include at least one clip which is fitted and coupled to the auditory ossicles.

The bellows member, the mass member, and the auditory ossicle coupling member may be provided as a non-magnetic material, parylene, or a silicone material.

According to another aspect of the present disclosure, a hearing aid includes an external unit having a microphone that converts an external voice into an electrical signal; an internal unit that is implanted into a skin and communicates with the external unit; a bellows vibration body coupled to auditory ossicles and formed of a non-magnetic material; and an audio transmission tube for transmitting the acoustic signal output from the internal unit to the bellows vibration body, wherein the bellows vibration body vibrates according to the acoustic signal transmitted through the audio transmission tube and transmits the vibration to the auditory ossicles.

The bellows vibration body may include a bellows member connected to the audio transmission tube and vibrating according to the acoustic signal; an auditory ossicle coupling member connected to one end of the bellows member and formed to be coupled to the auditory ossicles to transmit the vibration of the bellows member to the auditory ossicles; and a mass member formed on the other end of the bellows member so that the vibration of the bellows member is transmitted to the auditory ossicle coupling member.

The auditory ossicle coupling member may include at least one clip which is fitted and coupled to the auditory ossicles.

The hearing aid may further include a reinforcing spring wrapping the outside of the audio transmission tube.

The hearing aid may further include a cylinder formed on one end of the bellows member, wherein the cylinder may be connected to the audio transmission tube in a hollow state, and the auditory ossicle coupling member may be coupled to the cylinder.

Advantageous Effects

According to an embodiment of the present disclosure, the transmission efficiency of the vibration applied to the auditory ossicles may be increased by using the small bellows vibration body and the hearing aid including the same.

In addition, according to an embodiment of the present disclosure, excellent vibration efficiency characteristics may be maintained for acoustic signals in various frequency bands, especially, in a low frequency range.

In addition, according to an embodiment of the present disclosure, the frequency characteristics of the vibration transducer may be precisely controlled.

In addition, according to an embodiment of the present disclosure, unlike the method of implanting in the round window, there is less risk of injuring the nerve in the surgical procedure.

In addition, according to an embodiment of the disclosure, since the bellows vibration body formed of a non-magnetic material is used, there is an advantage in that there is no influence on the safety of the patient's auditory ossicles and the imaging device even in the case of the strong magnetic field such as MRI.

BEST MODE

Figure 1:
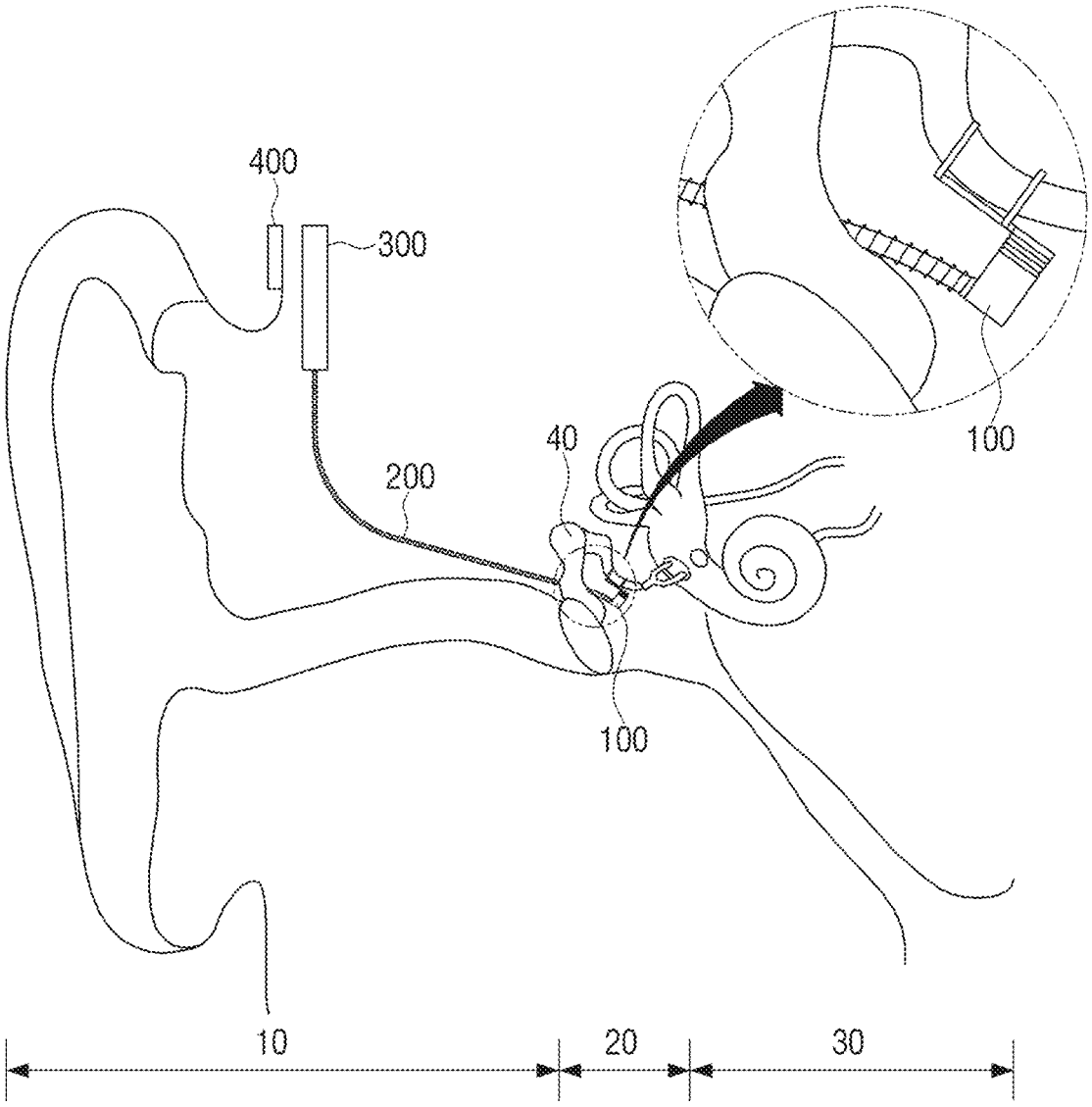
FIG. 1 is a view illustrating that a hearing aid according to an embodiment in the present disclosure is implanted.

Hereinafter, diverse embodiments of the disclosure will be described with reference to the accompanying drawings. However, it is to be understood that technologies mentioned in the present disclosure are not limited to specific embodiments, but include various modifications, equivalents, and/or alternatives according to embodiments of the present disclosure. Throughout the accompanying drawings, similar components will be denoted by similar reference numerals.

Terms used in the present disclosure may be used only to describe specific embodiments rather than restricting the scope of other embodiments. Singular forms are intended to include plural forms unless the context clearly indicates otherwise. Terms used in the present specification including technical and scientific terms have the same meanings as those that are generally understood by those skilled in the art to which the present disclosure pertains. Terms defined in a general dictionary among terms used in the disclosure may be interpreted as meanings that are the same as or similar to meanings within a context of the related art, and are not interpreted as ideal or excessively formal meanings unless clearly defined in the disclosure. In some cases, terms may not be interpreted to exclude embodiments of the disclosure even though they are defined in the disclosure.

A bellows vibration body 100 and a hearing aid according to an embodiment of the present disclosure will hereinafter be described in detail with reference to the accompanying drawings.

FIG. 1 is a view illustrating that a hearing aid according to an embodiment in the present disclosure is implanted.

Referring to FIG. 1, a hearing aid according to an embodiment in the present disclosure includes an external unit 400, an internal unit 300, an audio transmission tube 200, and a bellows vibration body 100. The internal unit 300 may be implanted into a skin of a temporal bone of a human body. A case 310 of the internal unit 300 may be provided as a biocompatible silicon material.

The external unit 400 may be provided to an outer surface of the skin of the human body, and transmit a power or a control signal required for an operation of the internal unit 300 to the internal unit 300. The internal unit 300 detects and processes the signal transmitted from the external unit 400, and outputs an acoustic signal. Such an acoustic signal is transmitted to the bellows vibration body 100 through the audio transmission tube 200. The bellows vibration body 100 vibrates by the acoustic signal, and the vibration in the bellows vibration body 100 is transmitted to the auditory ossicles 40 of a middle ear 20. Through this, a user may hear an external voice. The bellows vibration body 100 according to an embodiment of the present disclosure may be applied to various forms including a round window driving scheme as well as other type of hearing aids including an auditory ossicle implantable hearing aid.

Figure 2:
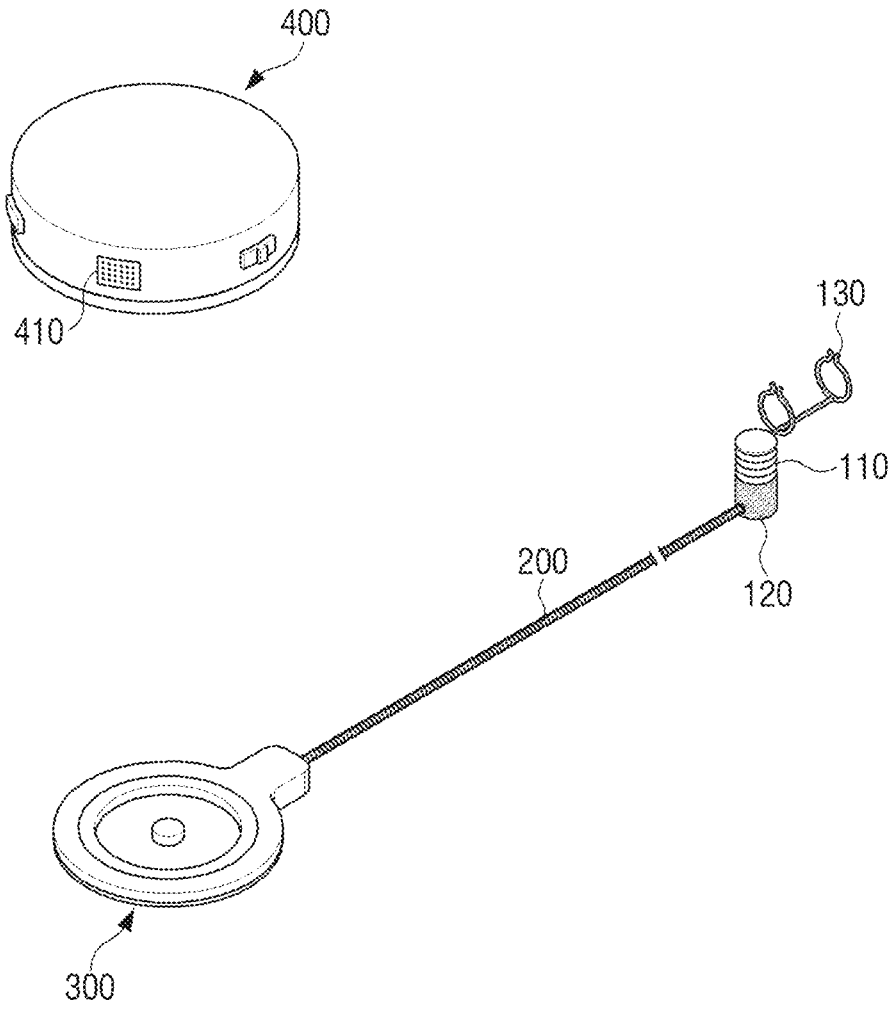
FIG. 2 is a perspective view illustrating the hearing aid according to an embodiment of the present disclosure.

FIG. 2 is a perspective view illustrating the hearing aid according to an embodiment of the present disclosure.

Referring to FIG. 2, the external unit 400 and a portion of the hearing aid which is implanted in the human body are illustrated.

The portion of the hearing aid which is implanted in the human body is implantable into the skin, and includes the internal unit 300 that communicates with the external unit 400, the bellows vibration body 100 that may be coupled to the auditory ossicles 40 and is formed of a non-magnetic material, and the audio transmission tube 200 for transmitting the acoustic signal output from the internal unit 300 to the bellows vibration body 100.

The bellows vibration body 100 may vibrate according to the acoustic signal transmitted through the audio transmission tube 200 and may apply an audio vibration to the auditory ossicles 40. The audio transmission tube 200 may have an inner diameter of about 0.3 mm to 0.6 mm, and may be air tube, which is a tube whose interior is hollow. The audio transmission tube 200 may be provided as a biocompatible silicon of a bendable material.

The external unit 400 may include a microphone 410 and an apparatus that may transmit the power or the control signal to the internal unit 300. Meanwhile, although it is illustrated that the microphone 410 is provided to the external unit 400, an installation position of the microphone 410 is not limited thereto. For example, the microphone 410 may also be provided to an ear portion, an eardrum, or the internal unit 300. The internal unit 300 and the bellows vibration body 100 are connected to each other by the audio transmission tube 200 whose interior is hollow.

An existing implantable hearing aid was connected through a conductive leading wire. In the hearing aid according to an embodiment of the present disclosure, since the connection between the internal unit 300 and the bellows vibration body 100 is implemented by the audio transmission tube 200, a risk of damage to the apparatus due to twisting of the leading wire during surgery is reduced.

Since the hearing aid according to an embodiment of the present disclosure transmits the audio vibration to the auditory ossicles 40 through the audio transmission tube 200, efficiency of audio transmission is high and it is easy to compensate for hearing loss. A configuration of the bellows vibration body 100 will be described with reference to FIG. 3.

Figure 3:
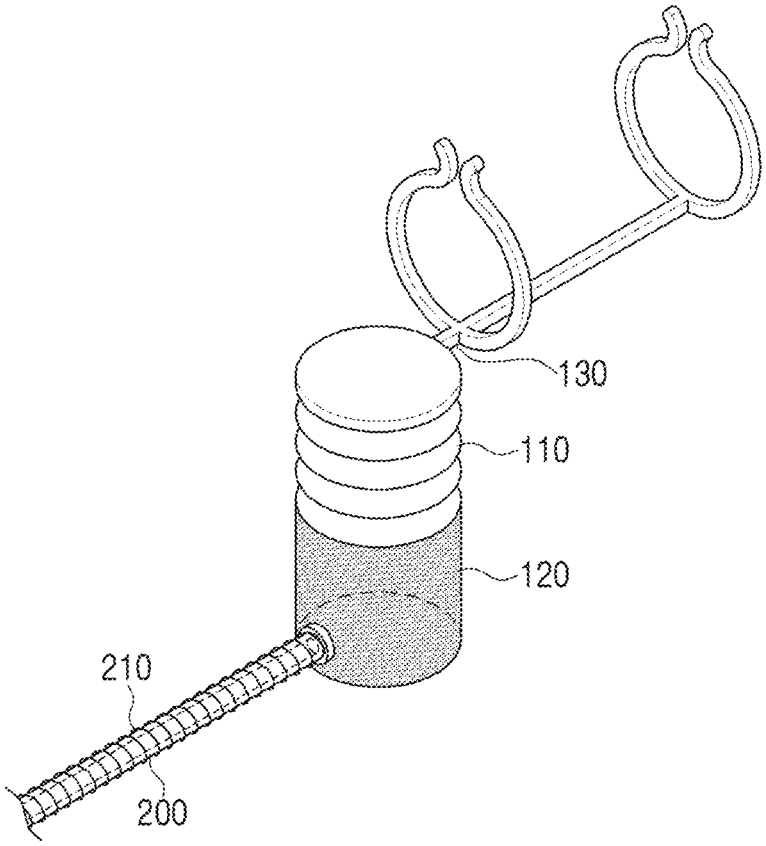
FIG. 3 is a perspective view illustrating a bellows vibration body according to an embodiment of the present disclosure.

FIG. 3 is a perspective view illustrating a bellows vibration body 100 according to an embodiment of the present disclosure.

Referring to FIG. 3, the bellows vibration body 100 includes a bellows member 110, a mass member 120, and an auditory ossicle coupling member 130.

The bellows member 110 that is connected to the audio transmission tube 200 that transmits the acoustic signal and vibrates according to the acoustic signal has corrugate bends. The corrugate bends have peaks and valleys, and the bellows vibration body 100 is vibrated by elasticity by the peaks and the valleys of the corrugate bends. The bellows member 110 may be configured in cylindrical shape to be suitable for transmission of vibration. The bellows member 110 may be provided as a biocompatible material. That is, the bellows member 110 may be provided as a polymer material such as parylene, silicone, or the like, or a metal material. However, when the bellows member 110 is provided as the metal material, the bellows member 110 may be provided as a material such as gold or titanium, which is a non-magnetic metal that is not influenced by an MRI imaging.

The mass member 120 may be formed on the other end of the bellows member 110 so that the vibration applied to the bellows member 110 is transmitted to the auditory ossicle coupling member 130, and may have a weight of about 25 mg. The weight of such a mass member 120 may be selected so as to determine appropriate vibration characteristics by an elastic coefficient and a damping coefficient according to the corrugate bend shape of the bellows member 110. The mass member 120 is also formed of the biocompatible material and is formed of the non-magnetic material.

The vibration body according to the present disclosure is formed of the non-magnetic material and is designed so as not to be influenced by the magnetic field in a magnetic field of 1.5 T or more. In the conventional floating mass transducer (FMT), the vibration body was vibrated by a signal transmitted using an electromagnet or a magnet inside. Since such a method is strongly influenced by an external magnetic field, noise may occur. In addition, when imaging the magnetic material on the characteristics of the MRI, because homogeneity of the magnetic field generated by the MRI is changed, artifacts in a measured image were generated due to distortion of the measured image, and a desired image was not obtained during the MRI imaging. If the bellows vibration body 100 according to the present disclosure is used, the bellows vibration body 100 vibrates due to shaking of the corrugate bends. In order to adjust such a vibration, the mass member 120 is attached, but because the magnet or a coil for forming the magnetic field for vibration is not included, it is possible to overcome the noise (cross talk) due to the external magnetic field or an existing disadvantage existing at the time of MRI imaging.

The auditory ossicle coupling member 130 is connected to one end of the bellows member 110, and is configured to be coupled to the auditory ossicles 40 to transmit the vibration of the bellows member 110 to the auditory ossicles 40.

The auditory ossicle coupling member 130 has a connection part connected to the bellows member 110, and has a coupling part coupled to the auditory ossicles 40. As in an embodiment of the present disclosure, the coupling part may be used as at least one or more clips. The coupling part of the auditory ossicle coupling member 130 may be formed of a material such as titanium which is a non-magnetic material while having appropriate rigidity.

When the audio transmission tube 200 is connected to the mass member 120, the audio transmission tube 200 may be inserted into the mass member 120 and be connected thereto to transmit the audio to the bellows member 110, or there may be a tubular void space in the mass member 120 to allow the acoustic signal to be transmitted within the mass member 120. Of course, the audio transmission tube 200 may be directly connected to the bellows member 110 and transmit the acoustic signal. In addition, in order to reduce loss of audio and to increase transmission efficiency of the acoustic signal in an audio transmission path of the audio transmission tube 200, connection portions of the audio transmission tube and the respective members may be sealed.

In addition, a reinforcing spring 210 wraps around the audio transmission tube 200 to reinforce the rigidity of the audio transmission tube 200 so that the shape of the audio transmission tube 200 may be maintained.

A coupling relationship between the shape of the clip portion and the respective members of the bellows vibration body 100 is not limited to the embodiment illustrated in FIG. 3. In order to avoid interference of the user's ear shape or the inside of the body with the member or to determine the vibration characteristics, the bellows vibration body 100 may have various shapes or may have various coupling methods. A coupling type of the bellows vibration body 100 to which another embodiment of the present disclosure is applied will be described with reference to FIGS. 4 and 5.

Figure 4:
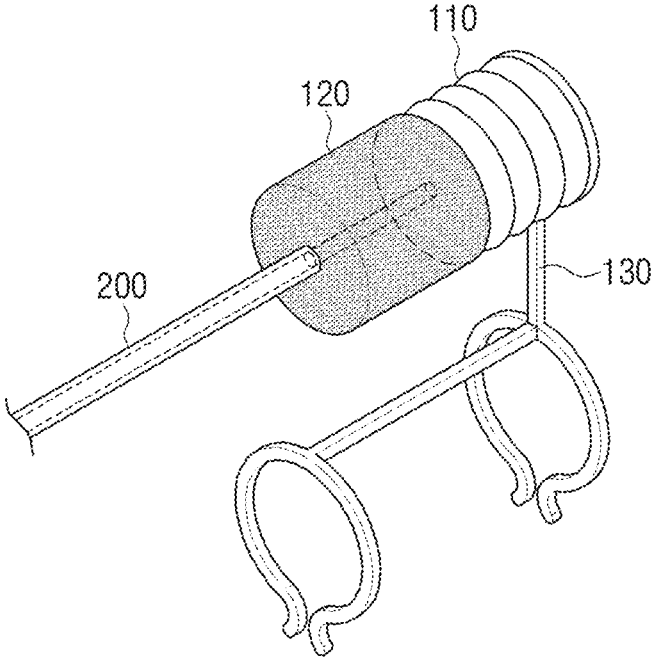
FIG. 4 is a view illustrating a bellows vibration body according to another embodiment of the present disclosure.

FIG. 4 is a view illustrating a bellows vibration body according 100 to still another embodiment of the present disclosure.

Referring to FIG. 4, the mass member 120 and the bellows member 110 are disposed on the same central axis, and the audio transmission tube 200 is connected to the bellows member 110 to penetrate through the mass member 120 along the central axis of the mass member 120. The auditory ossicle coupling member 130 is attached to an end of the bellows member 110.

The auditory ossicle coupling member 130 has a coupling part extending from an attachment portion with the bellows member 110. The coupling part has at least one or more clip portions. In FIG. 4, the coupling part is disposed to be parallel to the bellows member 110 and the mass member 120, but may be vertically disposed as in the arrangement of FIG. 3 according to situations or may be disposed in various forms according to circumstances.

Figure 5:
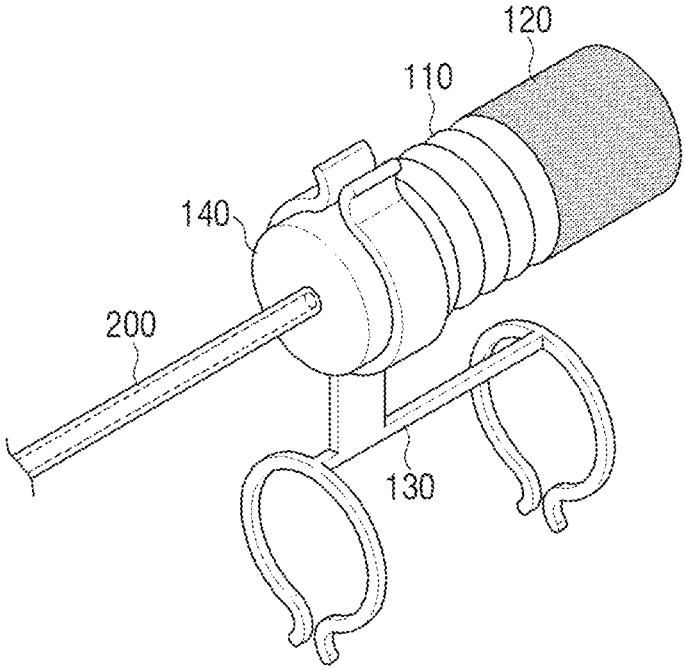
FIG. 5 is a view illustrating a bellows vibration body according to still another embodiment of the present disclosure.

FIG. 5 is a view illustrating a bellows vibration body 100 according to still another embodiment of the present disclosure.

Referring to FIG. 5, the bellows vibration body 100 further includes a cylinder 140 formed on one end of the bellows member 110. It may be seen that the cylinder 140 is connected to the audio transmission tube 200 in a hollow state, and the auditory ossicle coupling member 130 is fitted and coupled to the cylinder 140.

The cylinder 140 may be extended from the bellows member 110 and may be formed of the same material as that of the bellows member 110. The cylinder 140 extending from the bellows member 110 is formed in a cylindrical shape to facilitate the coupling with the auditory ossicle coupling member 130.

The auditory ossicle coupling member 130 has a connection part coupled to the cylinder 140 and also having the clip, and is fitted and coupled to the cylinder 140 by such a clip. Through this, the bellows member 110 may be fixed, and the vibration generated by the acoustic signal transmitted to the bellows member 110 may be transmitted to the auditory ossicles 40 coupled to the auditory ossicle coupling member 130 by the clip.

Figure 6:
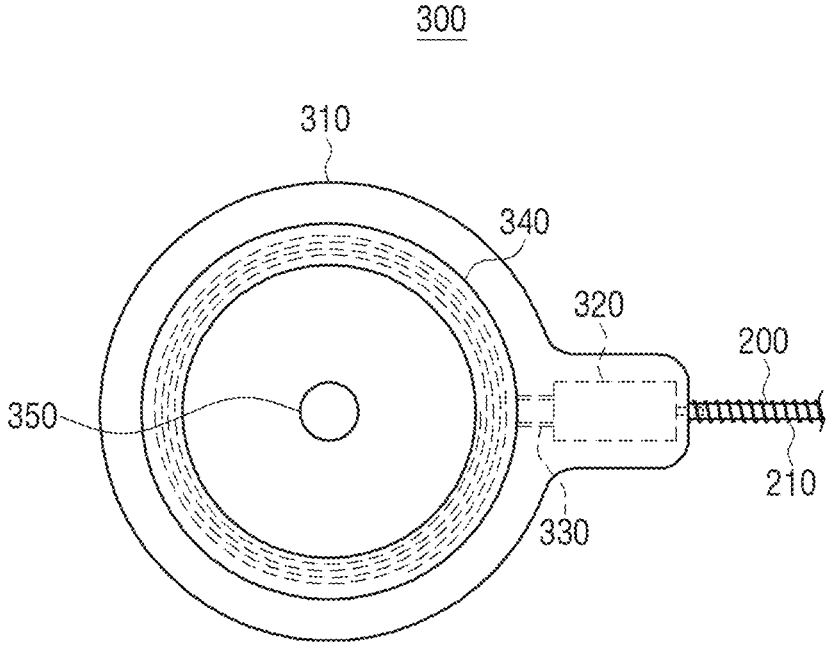
FIG. 6 is a perspective view illustrating an internal structure of an internal unit according to the present disclosure.

FIG. 6 is a perspective view illustrating an internal structure of an internal unit 300 according to the present disclosure.

Referring to FIG. 3, the internal unit 300 includes a case 310, a coil part 340, a receiver 320, a magnet member 350, and a leading wire member 330.

The internal unit 300 includes the case 310 that forms an outside of the internal unit 300, the coil part 340 positioned inside the case 310 and detecting an external signal, and the receiver 320 that is connected to the coil part 340 and the leading wire member 330 in the case 310 and processes the external signal to output an acoustic signal.

The external case 310 is manufactured of biocompatible silicon. Through this, the internal unit 300 may be implanted into the human body.

The coil part 340 is supplied with a power or a control signal from a coil of the external unit 400 by an electromagnetic induction phenomenon.

The magnet member 350 may fix a relative position of the external unit 400 and the internal unit 300 by the magnet of the external unit 400 and a magnetic force. The leading wire member 330 transmits the signal supplied through the coil part 340 to the receiver 320.

The receiver 320 processes the transmitted signal to generate the acoustic signal, and outputs the acoustic signal to the audio transmission tube 200. As the receiver 320, a typical hearing aid receiver 320 may also be used, and other audio generation apparatuses such as one or more Bluetooth audio receivers may be used.

Hereinafter, an audio transmission process of the hearing aid according to an embodiment of the present disclosure configured as described above is as follows.

The microphone 410 attached to the external unit 400 converts the acoustic signal into an electrical signal. The coil part 340 in the internal unit 300 communicates with the external unit 400 and receives the signal and the control signal. The signal transmitted to the coil part 340 in the internal unit 300 is transmitted to the receiver 320, and the receiver 320 processes the external signal to output the acoustic signal. The case 310 of the internal unit may be formed of a material having the same function as a silicon resin of which biocompatibility is verified by an institution such as FDA.

The acoustic signal output from the receiver 320 is transmitted through the audio transmission tube 200. The audio transmission tube 200 transmits the audio toward the auditory ossicles 40, and the acoustic signal is transmitted to the bellows member 110 attached to the end of the audio transmission tube 200.

The bellows vibration body 100 including the bellows member 110, the mass member 120, and the auditory ossicle coupling member 130 has the vibration characteristics depending on a design of the mass member 120 and the bellows member 110, and accordingly, the bellows vibration body 100 vibrates by the acoustic signal transmitted to the bellows member 110. Such a vibration is transmitted to the auditory ossicle coupling member 130, and the user may hear the voice due to the vibration of the auditory ossicles 40.

Figure 7:
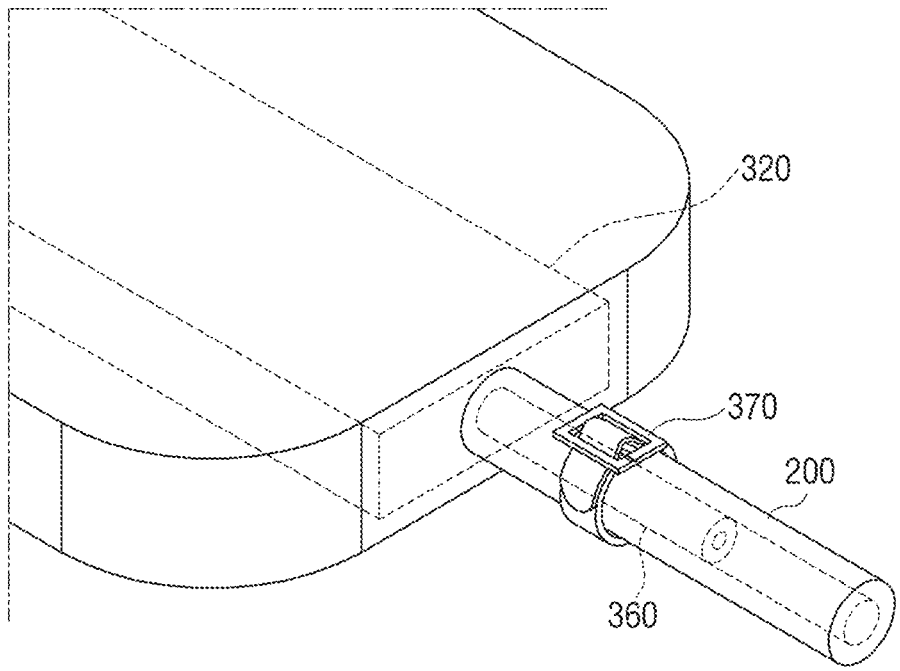
FIG. 7 is a view illustrating a connection part between the internal unit and an audio transmission tube according to the present disclosure in detail.

Referring to FIG. 7, the internal unit 300 may be easily separated from the audio transmission tube 200 by releasing a tightening band 370. Through this, when a patient wearing the implantable hearing aid according an embodiment of the present disclosure is in need of the MRI imaging, the internal unit including the magnetic material may be easily extracted to the outside through a simple operation. At the same time, it is possible to disinfect and reinstall the internal unit. Through this, the surgery inside a middle ear having high surgery difficulty may be minimized, and the vibration body which is initially installed inside the middle ear may be easily preserved. To this end, an audio outlet tube 360 of the receiver 320 is formed of a metal titanium tube, and has a length enough to hold the tightening band 370. The tightening band 370 is manufactured by using a biocompatible metal material and a polymeric material such as polyurethane.

Figure 8:
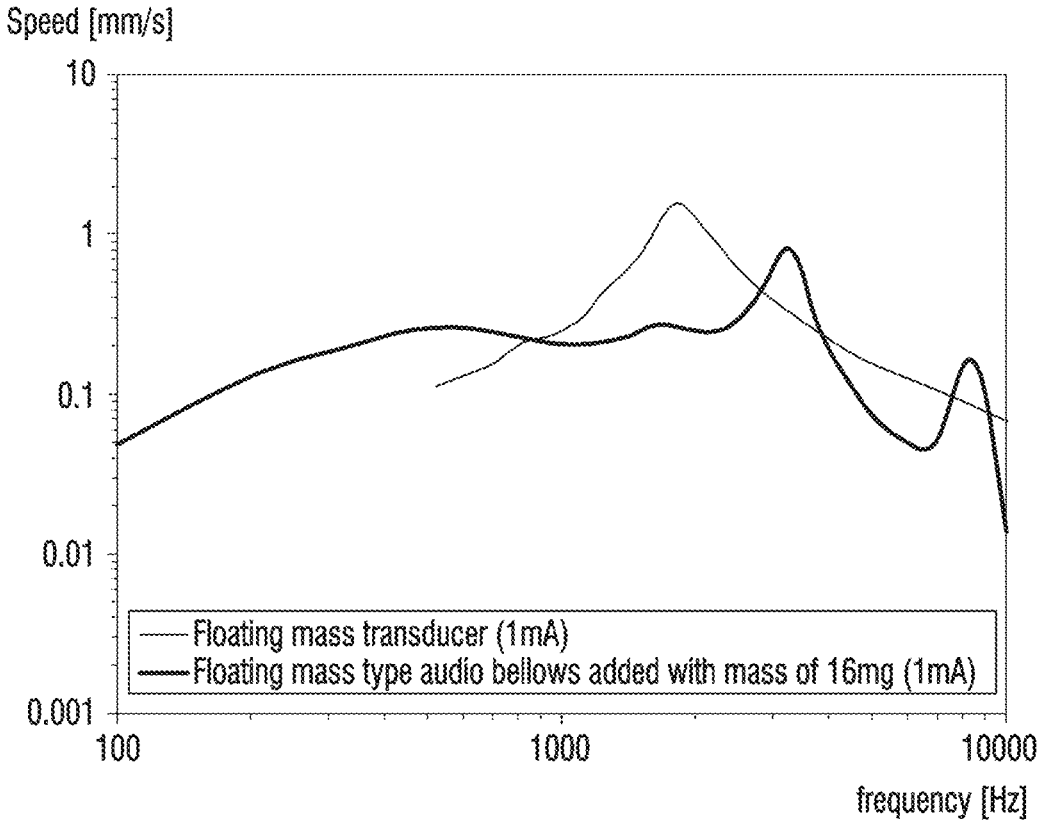
FIG. 8 is a graph illustrating vibration characteristics according to various types of hearing aids.

FIG. 8 is a graph illustrating vibration characteristics according to various types of hearing aids.

Referring to FIG. 8, it may be seen that the conventional floating mass transducer (FMT) does not show good vibration characteristics in a low frequency range. It may be seen from the graph that a resonant frequency of the conventional floating mass transducer occurs at approximately 1000 Hz to 2000 Hz. For this reason, the vibration characteristics hardly appear in the low frequency range (500 Hz or less).

On the other hand, it may be seen that a resonance frequency of a floating mass type audio bellows vibration body added with the mass of 16 mg, which is a bellows vibration body according to an embodiment of the present disclosure occurs at about 3000 Hz to 4000 Hz by using a receiver having a wide dynamic range. Because the resonance frequency occurs at a high frequency, the floating mass type audio bellows vibration body according to the present disclosure may have a better vibration characteristic at the low frequency and a flat vibration characteristic than the conventional floating mass type transducer (FMT).

In the graph of FIG. 7, the mass member 120 of 16 mg is added, but the weight of the mass member 120 may be selected differently depending on the required vibration characteristics.

Examples of the conventional implantable hearing aid include a method of directly transmitting the vibration from the round window and a method of using the floating mass type transducer using an electromagnetic force.

The hearing aid that applies the vibration to the round window uses a method of fixing the vibration body to the round window and directly applying the vibration of the bellows to the round window. However, the method of implanting the hearing aid to the round window has a risk of neural damage in a surgical procedure. When the vibration body is fixed, loss of the applied force occurs at the fixed end, so that the vibration of the acoustic signal may be lost.

The floating mass type audio bellows vibration body to which the mass is added corresponding to the embodiment of the present disclosure has the advantage that it may be designed to be suitable for the required vibration characteristics by adding the massing member 120 to adjust the mass of the mass member 120. In addition, the floating mass type audio bellows vibration body 100 may be installed on the auditory ossicles 40, and a surgery method thereof is easier than the method of fixing the vibration body in the round window.

The bellows vibration body and the hearing aid according to the embodiment of the present disclosure have the resonance frequency formed at about 3000 Hz and have the vibration characteristics even at the low frequency. Through this, it is possible to transmit the sound to the user in an entire range of an audible frequency (20 Hz to 20000 Hz).

In order to minimize the influence of the magnetic field and to have easiness of MRI tomography, the bellows vibration body 100, which is the vibration body of the transducer, does not use the magnet or the electromagnet as the mass member, and uses the method of transmitting the acoustic signal, not the electrical signal, to the bellows member 110. In addition, as the material of the bellows member 110, the mass member 120, and the auditory ossicle coupling member 130 that form the bellows vibration body 100, the non-magnetic material is used. Through this, unlike the conventional auditory ossicle implantable hearing aid, the problem that may occur during the MRI imaging is solved. In addition, by using the non-magnetic material, the crosstalk caused by the noise due to the external magnetic field is small.

In addition, because the audio transmission tube 200 is used and the number of twists is smaller than that in the case of using the conductive leading wire, the surgery may be easily performed.

Hereinabove, although the present disclosure has been described with reference to the limited embodiments and the accompanying drawings, the present disclosure is not limited thereto, but may be variously modified and altered by those skilled in the art to which the present disclosure pertains without departing from the spirit and scope of the present disclosure claimed in the claims.

What is claimed is:

1. A bellows vibration body, comprising:

a bellows member connected to an audio transmission tube that transmits an acoustic signal and vibration according to the acoustic signal;

an auditory ossicle coupling member connected to one end of the bellows member and formed to be coupled to auditory ossicles to transmit vibration of the bellows member to the auditory ossicles; and a mass member formed on an other end of the bellows member so that the vibration of the bellows member is transmitted to the auditory ossicle coupling member; and a cylinder formed on one end of the bellows member, wherein the cylinder is connected to the audio transmission tube in a hollow state, and the auditory ossicle coupling member is coupled to the cylinder.

2. The bellows vibration body as claimed in claim 1, wherein the mass member and the bellows member are disposed on a same central axis, and the audio transmission tube is connected to the bellows member to penetrate through the mass member along the central axis of the mass member.

3. The bellows vibration body as claimed in claim 1, wherein the auditory ossicle coupling member includes at least one clip which is fitted and coupled to the auditory ossicles.

4. The bellows vibration body as claimed in claim 1, wherein the bellows member, the mass member, and the auditory ossicle coupling member are provided as a non-magnetic material, parylene, or a silicone material.

5. A hearing aid comprising:

an external unit having a microphone that converts an external voice into an electrical signal;

an internal unit that is implanted into a skin and is embedded with a receiver that communicates with the external unit and generates acoustic signal;

a bellows vibration body coupled to auditory ossicles and formed of a non-magnetic material; and an audio transmission tube for transmitting the acoustic signal output from the internal unit to the bellows vibration body, wherein the bellows vibration body vibrates according to the acoustic signal transmitted through the audio transmission tube and transmits the vibration to the auditory ossicles.

6. The hearing aid as claimed in claim 5, wherein the bellows vibration body includes:

a bellows member connected to the audio transmission tube and vibrating according to the acoustic signal;

an auditory ossicle coupling member connected to one end of the bellows member and formed to be coupled to the auditory ossicles to transmit the vibration of the bellows member to the auditory ossicles; and a mass member formed on an other end of the bellows member so that the vibration of the bellows member is transmitted to the auditory ossicle coupling member.

7. The hearing aid as claimed in claim 6, wherein the auditory ossicle coupling member includes at least one clip which is fitted and coupled to the auditory ossicles.

8. The hearing aid as claimed in claim 5, further comprising:

an audio outlet tube connected to the receiver and inserted into the audio transmission tube; and a tightening band wrapping an outer circumference of the audio transmission tube, wherein the audio transmission tube is removable from the audio outlet tube of the receiver by the tightening band.

9. The hearing aid as claimed in claim 5, further comprising a reinforcing spring wrapping the outside of the audio transmission tube.

10. The hearing aid as claimed in claim 6, further comprising a cylinder formed on one end of the bellows member, wherein the cylinder is connected to the audio transmission tube in a hollow state, and the auditory ossicle coupling member is coupled to the cylinder.

* * * * *